United States Patent [19]

White

[11] 4,167,169

[45] Sep. 11, 1979

[54] FUEL FLOW CONTROL SYSTEM

[75] Inventor: Jack M. White, Florissant, Mo.

[73] Assignee: ACF Industries, Inc., New York, N.Y.

[21] Appl. No.: 766,190

[22] Filed: Feb. 7, 1977

[51] Int. Cl.[2] ..... F02D 1/04; F02D 1/06

[52] U.S. Cl. ..... 123/140 MC

[58] Field of Search .... 123/140 MC, 140 A, 140 MP, 123/140 R, 32 AE, 32 EA, 32 EE, 106–109, 139 AK, 139 AT, 139 E; 60/39.28 R

[56] References Cited

U.S. PATENT DOCUMENTS

| | | | |
|---|---|---|---|
| 2,902,989 | 9/1959 | Groves | 123/140 MC |
| 3,319,613 | 5/1967 | Begley et al. | 123/140 MC |
| 3,817,225 | 6/1974 | Priegel | 123/139 E |
| 3,908,360 | 9/1975 | Meyer et al. | 60/39.28 R |
| 3,935,851 | 2/1976 | Wright et al. | 123/139 E |
| 3,949,714 | 4/1976 | Mitchell | 123/140 MC |

*Primary Examiner*—Charles T. Jordan
*Attorney, Agent, or Firm*—Edward H. Casey

[57] ABSTRACT

A fuel flow control system which, in response to the true mass of air entering the throttle body of an engine, provides a regulated flow of fuel to the throttle body, thereby delivering the optimum mass fuel-air ratio to the engine and maintaining idealized engine performance. The air flow rate drawn through the throttle body by the engine is monitored along with air temperature and pressure, and an electronic control circuit computes the true mass of air and the ideal fuel flow rate which will produce the optimum mass fuel-air ratio. The circuit generates a command signal to a novel fuel flow regulating assembly which adjusts the fuel flow in response to the command signal. The regulating assembly includes a control valve positionable in response to the command signal and a pressure differential mechanism movably responsive to the control valve position. A fuel flow metering valve in turn is positioned by the pressure differential mechanism. A fuel flowmeter is included to measure the actual fuel flow rate delivered to the throttle body and a feedback signal generated from the flowmeter to the control circuit further aids in accurately positioning the metering valve and thereby insures correct fuel delivery to the engine.

8 Claims, 1 Drawing Figure

FUEL FLOW CONTROL SYSTEM

BACKGROUND OF THE INVENTION

In the field of internal combustion engines, great emphasis is being placed on the production of spark ignition engines having means for maximizing combustion of hydrocarbon fuels thereby reducing to a minimum the undesirable or hazardous exhaust emissions.

The invention relates to fuel flow control systems which provide a predetermined fuel flow to the throttle body of a spark ignition engine in response to the mass of air drawn through the throttle body by the action of the engine. Thus, the fuel flow is regulated to supply the proper mass of fuel for the particular mass of air drawn into the engine, thereby providing the optimum air-fuel ratio and ideal combustion characteristics. A number of such systems have been proposed in the prior art, examples of which are: U.S. Pat. No. 3,470,858 to Mycraft; U.S. Pat. No. 3,817,225 to Priegel; and U.S. Pat. No. 3,935,851 to Wright et al. The disclosures of the above-mentioned patents are herein incorporated by reference.

U.S. Pat. No. 3,935,851, in particular, discloses a fuel flow control system utilizing an electronic circuit to control fuel flow to the throttle body. The volume of air flow through the throttle body is monitored as well as the air temperature and pressure. With this information the electronic circuit can compute the true mass air flow rate. As disclosed in the patent, fuel temperature may also be sensed to accurately determine the proper volume of fuel flow which will create the optimum mass fuel-air ratio. It is further disclosed that signals representing other engine and environmental parameters may be utilized by the control circuit to modify fuel flow. Such other parameters may be the rate of change in throttle position indicating rapid engine acceleration or deceleration thus requiring a respectively richer or leaner fuel-air ratio; engine temperature since a cold engine requires a richer fuel-air mixture; measurement of actual fuel flow rate as a check against desired fuel flow rate; and exhaust gas parameters as a final check for proper combustion.

All of the systems of the above-mentioned patents provide means for monitoring engine or environmental parameters, and in response thereto control the flow of fuel to the engine by varying the speed of a fuel metering pump. One problem which has been encountered with these systems is that it is extremely difficult to produce an economical metering pump which may be controlled to provide the extremely accurate flow rates necessary for effecting a continually optimum fuel-air ratio. The main drawback in using a metering pump is that the output of the pump may be affected by changing pressure differentials across the pump working members. While the effect of this problem may be reduced by the apparatus disclosed by Meyer et al in U.S. Pat. No. 3,908,360, the accuracy of the system is still dependent on the precision and dependability of a relatively expensive metering pump.

SUMMARY OF THE INVENTION

The present invention improves upon the prior art systems mentioned hereinabove by providing inexpensive means for accurately and dependably regulating fuel flow to the carburetor throttle body in response to mass air flow and other engine and environmental parameters thereby optimizing the fuel-air ratio at all times during engine operation. The improved apparatus eliminates the need for a fuel metering pump and, instead, relatively inexpensive fluid control valves are utilized.

According to the principles of the invention, a control circuit computes the optimum fuel flow to the carburetor throttle body responsive to signals representing the volume air flow through the throttle body, the air temperature and the barometric pressure. The control circuit generates a command signal related to the desired fuel flow rate, which signal is received by a valve controller of a control valve. The valve controller positions the control valve to create a given control pressure in a control chamber. Responsive to a change in the control pressure, a differential pressure mechanism operates a metering valve which regulates and adjusts the fuel flow through a positively pressurized fuel passageway to the throttle body. It is important to note that the positive pressure may be generated by any conventional, inexpensive fuel pump such as a centrifugal pump or even a standard cam operated diaphragm pump, and no metering pump is necessary. The command signal may also be modified in response to feedback signals representing actual fuel flow rate and engine exhaust gas characteristics, and further adjustments to the command signal may be conditioned on other engine operating parameters such as engine temperature, fuel temperature and rate of change in throttle position.

It is, therefore, an object of the invention to provide a dependable system for accurately regulating the flow of fuel to a carburetor throttle body responsive to selected engine and environmental parameters to thereby continually create the optimum mass fuel-air ratio.

It is a further object of the invention to provide an apparatus of the character stated above which is simple and relatively inexpensive and which eliminates the need for a metering pump.

These as well as other objects and advantages of the improved fuel flow regulating apparatus according to the present invention will become more readily apparent from a reading of the following detailed description of the preferred embodiment in conjunction with the drawing wherein:

The sole FIGURE is a schematic representation of a preferred form of the improved fuel flow control system shown in the environment of a carburetor throttle body.

DETAILED DESCRIPTION OF THE PREFERRED EMBODIMENT

Figure 1:
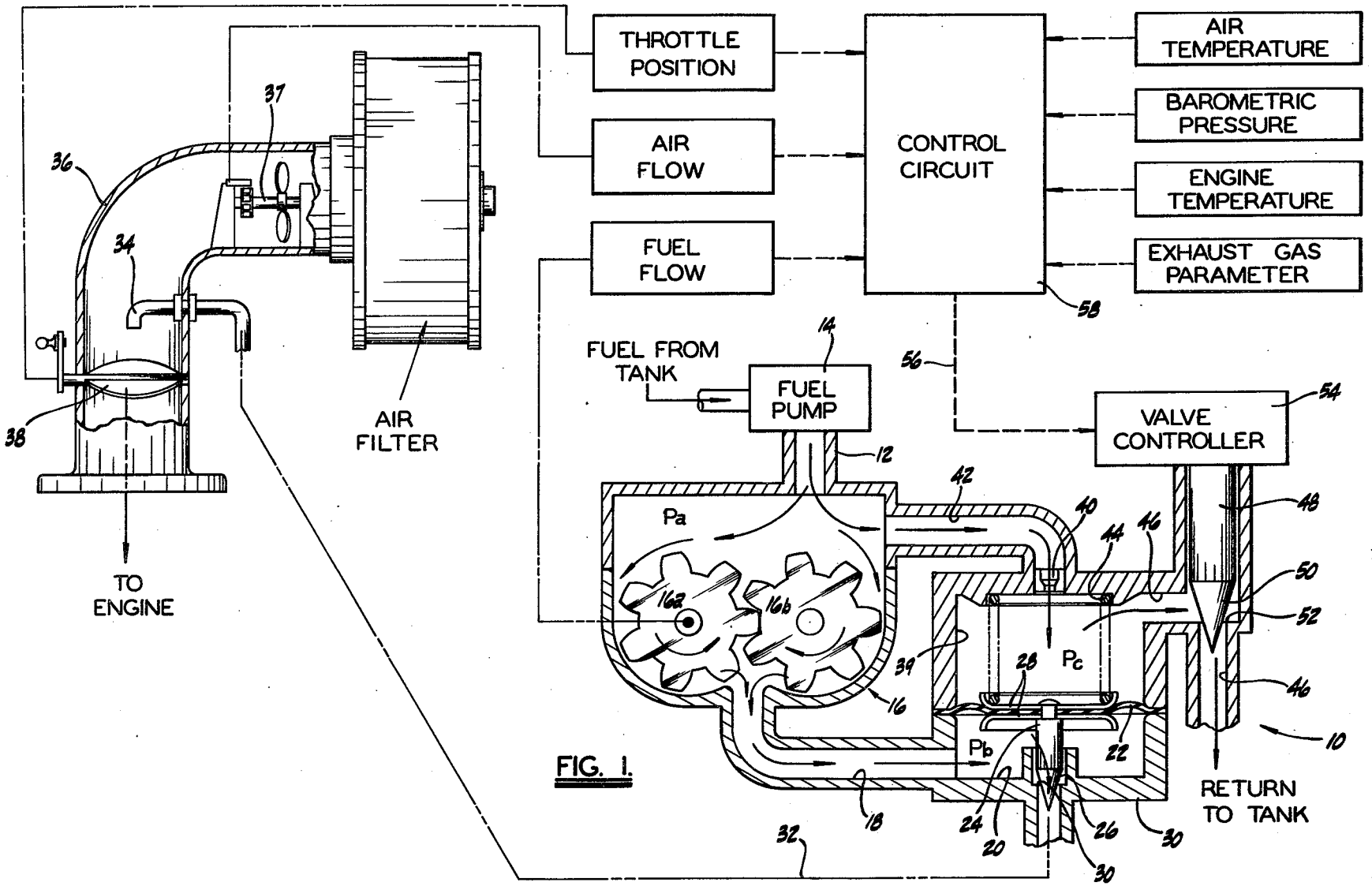

With reference to the sole FIGURE, there is depicted in schematic form an improved fuel flow control system 10 having a fuel inlet 12 adapted to receive a continuous flow of fuel from a fuel tank (not shown) by means of a conventional fuel pump 14. A major portion of the fuel flow entering inlet 12 passes through a fuel flowmeter 16, having intermeshing gears **16*a*, 16*b*, and is directed via passageway 18 to fluid chamber 20. Fluid chmber 20 is in part defined by a differential pressure mechanism, preferably depicted as a fluid-impervious flexible diaphragm 22 which is affixed to and controls the operation of metering valve 24. Metering valve 24 comprises a tapered valve head 26 perpendicularly secured to the underside of diaphragm 22 by means of a pair of plates 28 positioned on either side of diaphragm 22. As will be explained more fully hereinafter, valve head 26 cooperates with valve seal 30** and is positioned by diaphragm 22 to regulate the fuel flow which is permitted to pass into fuel line 32 for ultimate delivery through nozzle 34 into carburetor throttle body 36 containing air flowmeter 37 and air throttle valve 38.

Above diaphragm 22 and defined partly thereby is a control fluid chamber 39 having restricted inlet 40 through which a continuous flow of fuel is directed from fuel pump 14 via passage 42. Control fluid chamber 39 has positioned therein compression spring 44, of very low spring rate, which is included only as a safety measure to urge diaphragm 22 downwardly and thus valve head 26 into a closed position when the engine is turned off. During normal operation spring 44 has only a minimal effect on the operation of the system. An outlet passage 46 from chamber 39 contains a control valve 48 having tapered head 50 which cooperates with control valve seat 52 to permit an infinitely adjustable flow of fuel from chamber 39 through outlet passage 46 for return to the fuel tank. The position of head 50 is determined by a valve controller 54 which may be, for example, a conventional variable position solenoid or a reversible electric motor with an internally threaded rotor cooperating with an externally threaded valve stem to precisely position valve head 50 with respect to valve seat 52 responsive to an electrical command signal, represented by dashed line 56, generated by control circuit 58.

Control circuit 58 receives electrical signals representing air flow, air temperature and barometric pressure as well as any of various other engine and environmental parameters. As shown in the drawing, the other parameters which may be considered for optimizing engine performance are rate of change of the position of throttle valve 38, engine temperature, exhaust gas characteristics such as oxygen content and actual fuel flow rate to the throttle body 36 as measured by flowmeter 16. Since the specific structure of control circuit 58 forms no part of the present invention, it is deemed unnecessary to specifically describe same. Instead, reference is made to the circuits disclosed in the aforementioned U.S. Pat. Nos. 3,817,225 and 3,935,851, which circuits could be utilized with only minor modification to operate valve controller 54 of the instant invention.

In operation, fuel pump 14 delivers fuel from the fuel tank to fuel inlet 12 at a pressure $P_a$. Fuel flows through fuel flowmeter 16 and passageway 18 to fluid chamber 20 where the underside of diaphragm 22 is acted upon by the fluid pressure therein $P_b$. Fuel also flows from inlet 12 through passage 42 and restricted inlet 40 to control fluid chamber 39 wherein the upperside of diaphragm 22 is acted upon by the control pressure therein $P_c$ and the slight force of compression spring 44.

It can be seen that the control pressure $P_c$ will vary according to the flow rate from control chamber 39 through outlet passage 46 as adjusted by control valve 48. Further, the pressure in fluid chamber 20 will vary according to the position of metering valve 24. For example, as control valve 48 increasingly restricts the flow through outlet passage 36 the control pressure $P_c$ will increase tending to drive diaphragm 22 and metering valve 24 down to restrict the fuel flow through fuel line 32. Restricting fuel flow through fuel line 32 will cause the pressure $P_b$ to increase until the forces are equalized on each side of diaphragm 22. Likewise, as control valve 48 permits greater fluid flow through outlet passage 46, control pressure $P_c$ will decrease allowing diaphragm 22 to rise and metering valve 24 to increase the fuel flow through fuel line 32. This action will result in a decrease in pressure $P_b$ and movement of metering valve 24 will stop when the forces acting on both sides of diaphragm 22 are again equalized.

As stated hereinabove, the position of control valve 48 is precisely controlled by valve controller 54, which is preferably a variable position solenoid or a reversible electric motor, which is operated in response to command signal 56 generated by control circuit 58. Since control circuit 58 is continually presented with signals representing volume of air flow, air temperature and barometric pressure, command signal 56 may position control valve 48 to provide the proper fuel flow through fuel line 32 for the true mass of air being drawn into the engine through throttle body 36. In order to assure that the proper fuel flow is actually being transmitted through fuel line 32, flowmeter 16 generates a feedback signal to control circuit 58. Further, a signal representing exhaust gas characteristics is relayed to the control circuit as a further check that the proper fuel-air ratio is being fed to the engine and if not, compensation may be made in command signal 56. Also, a signal representing engine temperature may be utilized to provide a richer air-fuel mixture during cold starting periods and a signal representing rapid change in throttle position may be utilized to adjust fuel flow and thus the fuel-air ratio. Therefore, it can be seen that the position of metering valve 24 and the fuel flow rate determined thereby is ultimately controlled by the selected engine and environmental parameters represented by the electrical signals enumerated in the drawing.

It has been shown that a fuel flow control system according to the principles of the instant invention provides for dependable and accurate regulation of fuel flow to a carburetor throttle body responsive to mass air flow and other selected engine and environmental parameters thereby continually creating the optimum mass fuel-air ratio for the engine. The apparatus is simple and inexpensive eliminating the need for a metering pump.

It can be appreciated that numerous modifications can be made to the preferred form of the apparatus without departing from the spirit and scope thereof, for example, the control pressure applied to the top of diaphragm 22 could be evolved from an air pressure source or another liquid source. It is, therefore, requested that the scope of the invention be determined solely by the claims appended hereto.

I claim:

1. A fuel flow control system for maintaining a predetermined optimum fuel-air mass ratio for an engine comprising:

electronic circuitry means for generating a command signal at least in part representative of the volume flow of air drawn into said engine through a carburetor throttle body;

a fuel flow passageway adapted to be pressurized by a fuel pump;

metering valve means in said fuel flow passageway for regulating the fuel flow rate through said passageway; and control means responsive to said command signal for controlling the operation of said metering valve means;

said control means including a differential pressure mechanism movable in response to a change in pressure differential between a control pressure and the pressure of said fuel in said passageway, said control means further including a control valve movable in response to said command signal to adjust said control pressure, said differential pressure mechanism including a diaphragm attached to said metering valve means, one sid of said diaphragm being subjected to said control pressure and the opposite side of said diaphragm being subjected to the pressure of said fuel within said passageway, and spring means acting on said diaphragm to urge said metering valve means into a closed position when said engine is turned off, and a control chamber at least partially defined by said one side of said diaphragm, a fuel flowmeter in said passageway located upstream of said metering valve means, and a restricted fuel passage extending between said control chamber and a point in said fuel flow passageway located upstream of said flowmeter; and said metering valve means being positionable in response to movement of said differential pressure mechanism.

2. A fuel flow regulating apparatus as specified in claim 1 and further characterized by:

said control valve being positioned by a variable position solenoid mechanism.

3. A fuel flow regulating apparatus as specified in claim 1 and further characterized by:

said control valve being positioned by a reversible electric motor mechanism.

4. A fuel flow regulating apparatus as specified in claim 1 and further characterized by:

an outlet passage from said control chamber;

said control valve being in said outlet passage and controlling the rate of flow therethrough.

5. A fuel flow regulating apparatus as specified in claim 1 and further characterized by:

said fuel flowmeter measuring the actual rate of fuel flow through said passageway and generating a feedback signal to said electronic circuitry means in response thereto; and said command signal being, in part, representative of said feedback signal.

6. A fuel flow regulating apparatus as specified in claim 1 and further characterized by:

said electronic circuitry means generating said command signal at least in part representative of the mass flow of air drawn into said engine as computed by input signals representing volume flow of air, air temperature and barometric pressure.

7. A fuel flow regulating apparatus as specified in claim 6 and further characterized by:

said electronic circuitry means being capable of altering said command signal responsive to signals representing additional engine and environmental parameters.

8. A fuel flow regulating apparatus as specified in claim 7 wherein:

said additional parameters include engine temperature, rate of change in throttle position and exhaust gas characteristics.

* * * * *